United States Patent [19]

Hong

[11] Patent Number: 4,997,206

[45] Date of Patent: Mar. 5, 1991

[54] LOOSE-LEAF PHOTO ALBUM

[76] Inventor: Wu-Hsin Hong, No. 20, Alley 7, Lane 336, Anping Road, Tainan, Taiwan

[21] Appl. No.: 434,885

[22] Filed: Nov. 9, 1989

Related U.S. Application Data

[63] Continuation-in-part of Ser. No. 257,325, Oct. 13, 1988, Pat. No. 4,896,900.

[51] Int. Cl.[5] ..... B42D 5/00; E05D 7/12; E05D 7/10

[52] U.S. Cl. ..... 281/15.1; 16/254; 16/266

[58] Field of Search ..... 287/15.1, 21.1; 402/28, 402/38, 26; 40/530, 546; 16/266, 267, DIG. 13, DIG. 29

[56] References Cited

U.S. PATENT DOCUMENTS 2,963,734 12/1960 Huget ..... 16/254

4,161,017 7/1979 Pierce et al. ..... 16/266

FOREIGN PATENT DOCUMENTS 2559197 8/1985 France ..... 16/254

1292109 10/1972 United Kingdom ..... 16/254

*Primary Examiner*—Douglas D. Watts

*Assistant Examiner*—Paul M. Heyrana, Sr.

*Attorney, Agent, or Firm*—Ladas & Parry

[57] ABSTRACT

A loose-leaf binder is disclosed, such as a loose-leaf photo album or a loose-leaf file binder, on which is disposed a plurality of hinge members having a pillar at one end and an axially concave knuckle at the other end. A longitudinal slit is formed on the outer wall of the concave knuckle and an extension bore is formed axially in the concave knuckle so that a pillar may be snapped into the concave knuckle via the longitudinal slit and the free end of the pillar can be inserted into the extension bore so as to increase the radial engaging force between the hinge members.

6 Claims, 2 Drawing Sheets

LOOSE-LEAF PHOTO ALBUM

CROSS-REFERENCE OF RELATED APPLICATION

This invention is a continuation-in-part of co-pending U.S. application Ser. No. 07/257,325, filed on Oct. 13, 1988, now U.S. Pat. No. 4,896,900 issued Jan. 30, 1990.

BACKGROUND OF THE INVENTION

This invention relates to a loose-leaf binder, and more particularly to a loose-leaf binder, such as a loose-leaf photo album or a loose-leaf file binder, having a plurality of pages neatly piled together, every abutting two of which are detachably and rotatably connected to each other by a plurality of axially aligned hinge members alternately formed along a pair of corresponding edges of said pages.

U.S. patent application Ser. No. 07/257,325 discloses a loose-leaf photo album the loose-leaf pages of which are capable of being easily and quickly engaged with each other by the insertion of the protruding pillars, which are provided at one part of the end portions of the hinge members alternately formed along the edge of each of the pages, and the concave knuckles of the remaining portion of the end portions of said hinge members via the axial slits formed on said remaining end portions of said hinge member. In addition, the engaging force between the adjacent hinge members of the loose-leaf photo album of application Ser. No. 07/257,325 can be increased by increasing the effective engaging length between said concave knuckle of said hinge member and the protruding pillar of the other connecting hinge member. However, because said protruding pillar, which is received in said concave knuckle, is merely clamped by the flexible wall of said concave knuckle, the engaging force between said concave knuckles and said protruding pillars may not be sufficient to prevent said loose-leaf pages, which are substantially thick and heavy, from being radially separated from one another via said axial slit in said hinge member.

SUMMARY OF THE INVENTION

Therefore, it is a primary object of this invention to provide a loose-leaf binder which is capable of securely hinging together a number of thick and heavy loose-leaf pages.

Accordingly, a loose-leaf binder of this invention includes a plurality of pages neatly piled together, every abutting two of which are detachably and rotatably connected to each other by a plurality of axially aligned hinge members alternately formed along a pair of corresponding edges of said pages. Every neighboring two of the axially aligned hinge members are rotatably engaged with each other by an axially concave knuckle and an axially protruded pillar which are respectively formed at said hinge members' adjacent axial ends. Said axially concave knuckle has an outer wall formed by one of said adjacent ends defining a concave portion which extends from the free end of said concave knuckle to an inner terminating end of said concave knuckle. The wall of the concave knuckle has a longitudinal slit extending from the free end of said concave knuckle to said inner terminating end of said concave knuckle and radially aligned and communicating with said concave portion of said concave knuckle. The concave knuckle further has an extension bore extending axially inward from said terminating end of the concave knuckle so that the free end of the axially protruded pillar can be inserted into said extension bore after said pillar is inserted into said concave knuckle via said longitudinal slit.

Therefore, in accordance with this invention, a strong radially engaging force will exist between the hinge members of the loose-leaf binder so as to prevent the pillar of a hinge member from being separated from the concave knuckle of an adjacent hinge member.

BRIEF DESCRIPTION OF THE DRAWINGS

Other features and advantages of this invention will become apparent in the following detailed description of the preferred embodiments of this invention with reference to the accompanying drawings, in which:

FIG. 2 is an enlarged view of the concave knuckle of a hinge member of the loose-leaf binder of the first preferred embodiment of this invention;

DETAILED DESCRIPTION OF THE PREFERRED EMBODIMENT

Figure 1:
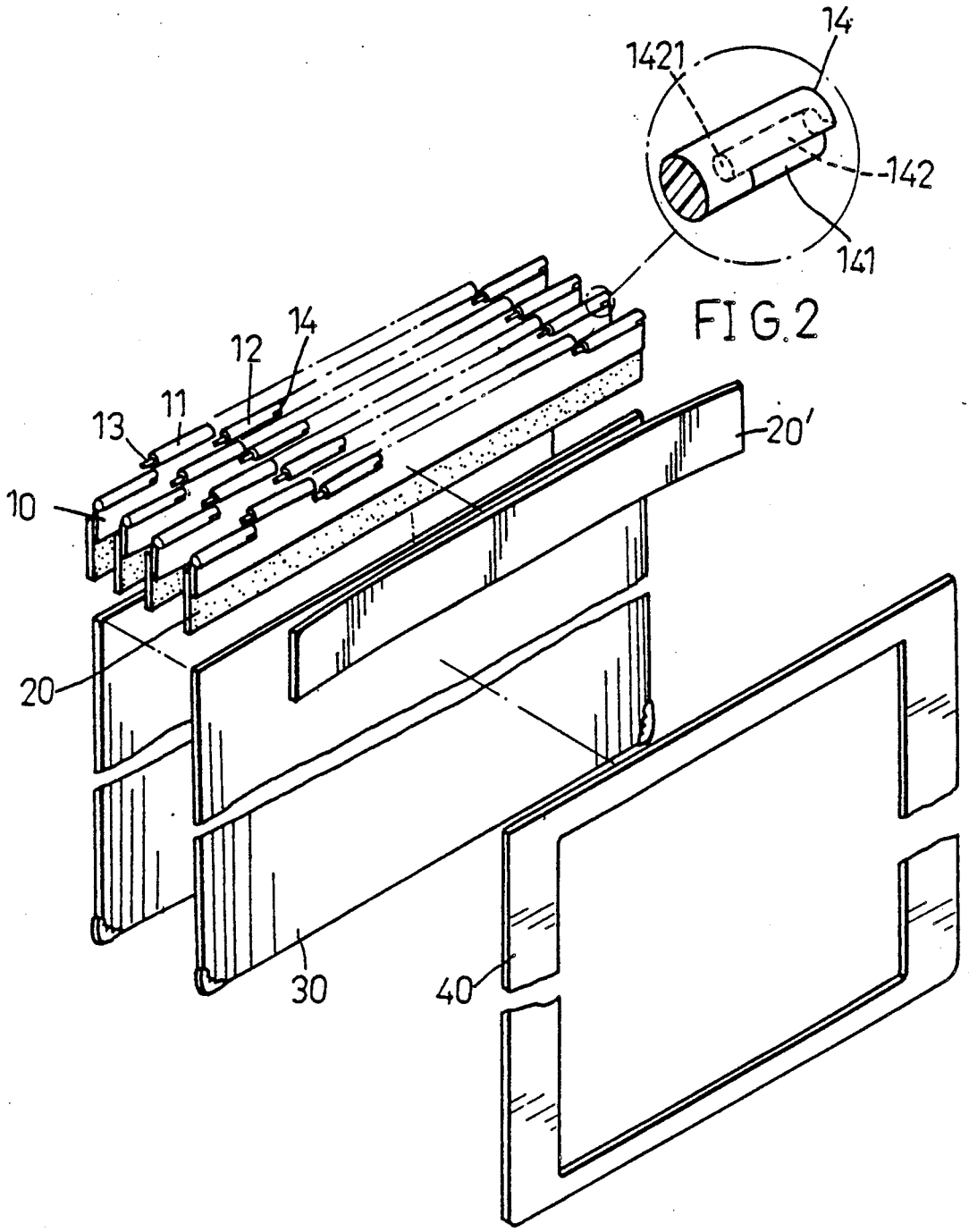
FIG. 1 is an exploded perspective view of a first preferred embodiment of a loose-leaf binder according to this invention.
Figure 3:
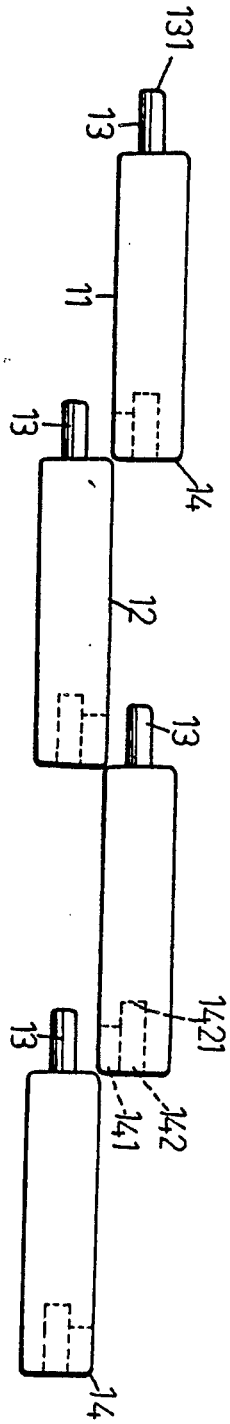
FIG. 3 is a schematic view of the hinge members of the first preferred embodiment of this invention.

Referring now to FIG. 1, a loose-leaf binder of this invention is shown, which comprises loose-leaf pages 10, two strips of adhesive tape 20, 20', a content page 30 and a photo strut 40. The loose-leaf pages 10 are made of a flexible material, (for example, a plastic material), each of which is integrally formed as a longitudinal plate. On the loose-leaf pages 10 are disposed a plurality of first hinge members 11 and a plurality of second hinge members 12 alternately formed on the two sides and along the edge thereof. Each of the first and second hinge members 11, 12 has a pillar 13 formed at one end thereof protruding in the same direction and a concave knuckle 14 formed at the other end thereof, as shown in FIG. 3.

Figure 4:
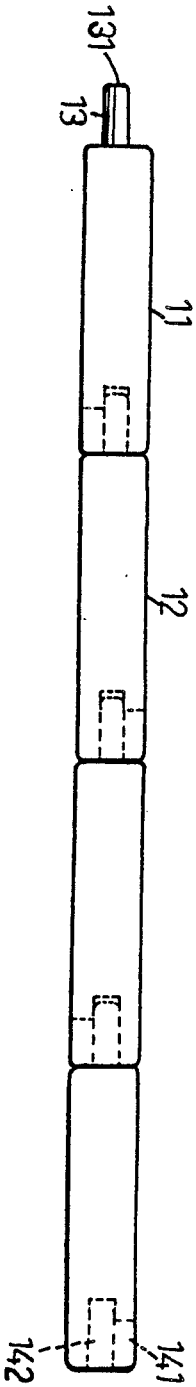
FIG. 4 is a schematic view of the hinge members of FIG. 3 which are assembled by means of insertion of the pillars into the concave portions through the longitudinal slits.

Referring to FIG. 2, the axially concave knuckle 14 of the hinge members 11, 12 has a longitudinal slit 141 extending from the free end of said concave knuckle 14, traversely passing through the wall of said knuckle and connecting with an axially concave portion 142 defined by said wall of said concave knuckle 14. The longitudinal slit 141 is tapered so that said slit 141 enlarges toward an outer surface of the hinge members enabling the axially protruded pillar 13 to be snapped into and stably received within the axially concave portion 142 of the knuckle 14, via said longitudinal slit 141 due to the flexibility of the walls of the hinge members 11, 12. An extension bore 1421 extends axially inward from an inner terminating end of the concave knuckle 14 so that, due to the flexibility of the walls of the hinge members 11, 12, of the pillars 13, and of the loose leaf pages 10 the free end 131 of the axially protruded pillar 13 can be inserted into said extension bore 1421 after the pillar 13 is inserted into said concave knuckle 14 via the longitudinal slit 141, as best illustrated in FIG. 4. The protruding pillars 13 can be pressed into the longitudinal slits 141 and the axial concave portion 142 by the flexing of the body of hinge members 11, 12 and of pillars 13 so that the free ends 131 of the pillars 13 can be forced to slide into the longitudinal slits 141 and into the extension bores 1421. Alternatively, and as is inherent from the arrangement and construction shown and described, the free ends 131 of the pillars 13 may be inserted at an inclined angle to the longitudinal slits 141, so that the ends of the pillars 131 can enter the extension bores 1421. Thus, even though pillars 13 are slightly longer than slits 141, pillars 13 can be inserted into the extension bores 1421. In this way, the radial engaging force between the first and second hinge members 11, 12 is sufficient to resist a heavy load exerted by a number of content pages 30 connected to the loose-leaf pages 10.

Referring again to FIG. 1, the content page 30 is substantially a rectangular piece of cardboard. The layers of a cardboard-like material 20, 20', the joining surfaces of which are coated with a glue-like substance, are separated at one edge thereof and simultaneously and tightly attached to both the loose-leaf pages 10 and the content page 30 via said glue-like substance. Thus, the loose-leaf pages 10 and the content page 30 are integrally formed.

Figure 5:
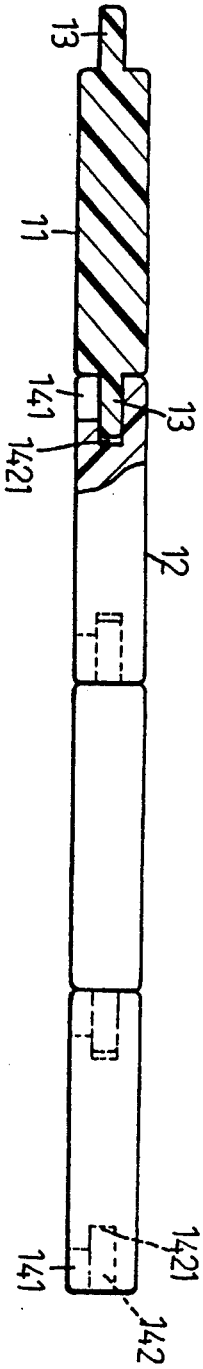
FIG. 5 is a partially sectional schematic view of the hinge members of a second preferred embodiment assembled according to this invention.

In assembly, each of the axially protruded pillars 13 of a first hinge member 11 of a loose-leaf page 10 is first inserted into the corresponding concave knuckle 14 of a second hinge member 12 of an adjacent loose-leaf page 10 via said longitudinal slit 141 of said corresponding concave knuckle 14. The free end 131 of said axially protruded pillar 13 is then fitted into the extension bore 1421 of said corresponding concave knuckle 14. In this way, a photo album of this invention is completed when all the loose-leaf pages 10 with hinge members 11, 12 are rotatably piled together Referring to FIG. 5, a second preferred embodiment according to this invention is shown. In this embodiment, each of the loose-leaf pages 10 of the loose-leaf binder has a structure similar to that of the abovementioned embodiment except that the axially protruded pillars 13 are formed on each end of the first hinge member 11 and the axially concave knuckles 14 are formed at the ends of the second hinge member 12. According to the assembling process of the abovementioned embodiment, together with hinge members of the second embodiment, a complete photo album may be created.

With this invention thus explained, it is apparent that numerous modifications and variations can be made without departing from the scope and spirit of this invention. It is therefore intended that this invention be limited only as indicated in the appended claims.

What is claimed is:

1. A loose-leaf binder having a plurality of pages neatly piled together, every abutting two of which are detachably and rotatably connected with each other by a plurality of axially aligned hinge members alternately formed along a pair of corresponding edges of said pages;

every neighboring two of the axially aligned hinge members being detachably and rotatably engaged with each other by an axially concave knuckle and an axially protruded pillar which are respectively formed at the adjacent axial ends thereof;

said axially concave knuckle having an outer wall formed by one of said adjacent ends thereof and defining a concave portion which extends from a free end of said concave knuckle to an inner terminating end of said concave knuckle;

said outer wall having a longitudinal slit extending from the free end of said concave knuckle to said inner terminating end of said concave knuckle;

said longitudinal slit being radially aligned with said concave portion of said concave knuckle and traversely passing through said wall so as to communicate with said concave portion of said concave knuckle;

said axially protruded pillar being formed to be inserted into said concave knuckle via said longitudinal slit;

wherein the improvement is characterized in that said concave knuckle also has an extension bore extending axially inward from said inner terminating end of said concave knuckle so that a free end of said pillar can be inserted into said extension bore after said pillar is inserted into said concave portion via said longitudinal slit.

2. A loose-leaf binder as claimed in claim 1, wherein said longitudinal slit is tapered so that said slit enlarges toward an outer surface of each of said hinge members.

3. A loose-leaf binder as claimed in claim 2, wherein said hinge members are made of a flexible material.

4. A loose-leaf page comprising:

a piece of cardboard which has an edge having a plurality of first hinge members and a plurality of second hinge members alternately formed on the two sides thereof along said edge, so that a similar page with similar hinge members can be rotatably connected to said loose-leaf page by engaging the first hinge members thereof with the second hinge members of said loose-leaf page, and another of said similar pages can be rotatably connected with said loose-leaf page by engaging the second hinge members thereof with the first hinge members of said loose-leaf page;

said first and second hinge members each having a first and second end portion, each said first end portion having an axially concave portion defined by a wall formed therearound, which constitutes an axially concave knuckle, said concave portion extending from a free end of said concave knuckle to an inner terminating end of said concave knuckle, said wall having a longitudinal slit extending from said free end of said concave knuckle, said longitudinal slit being radially aligned with said axially concave portion and transversely passing through said wall so as to communicate with said axially concave portion, each said second end portion having a pillar axially protruded therefrom, said pillar being constructed to be inserted into a corresponding knuckle of an adjacent loose-leaf page via said longitudinal slit;

wherein said concave knuckle has an extension bore extending axially inward from said inner terminating end of said concave knuckle so that a free end of said pillar can be inserted into said extension bore after said pillar is inserted into said concave portion via said longitudinal slit.

5. A loose-leaf page as claimed in claim 4, wherein said longitudinal slit is tapered so that said slit enlarges toward an outer surface of each of said hinge members.

6. A loose-leaf page as claimed in claim 5, wherein said hinge members are made of a flexible material.

* * * * *